US010400756B2

(12) United States Patent
Tournebize et al.

(10) Patent No.: US 10,400,756 B2
(45) Date of Patent: Sep. 3, 2019

(54) POSITIVE-DISPLACEMENT PISTON PUMP AND ROTARY DISTRIBUTION MEANS

(71) Applicants: COMPAGNIE GENERALE DES ETABLISSEMENTS MICHELIN, Clermont-Ferrand (FR); MICHELIN RECHERCHE ET TECHNIQUE, S.A., Granges-Paccot (CH)

(72) Inventors: Aurélien Tournebize, Clermont-Ferrand (FR); Pierre Annet, Clermont-Ferrand (FR)

(73) Assignees: COMPAGNIE GENERALE DES ETABLISSEMENTS MICHELIN, Clermont-Ferrand (FR); MICHELIN RECHERCHE ET TECHNIQUE S.A., Granges-Paccot (CH)

( * ) Notice: Subject to any disclaimer, the term of this patent is extended or adjusted under 35 U.S.C. 154(b) by 94 days.

(21) Appl. No.: 15/323,025

(22) PCT Filed: Jun. 30, 2015

(86) PCT No.: PCT/EP2015/064777
§ 371 (c)(1),
(2) Date: Dec. 29, 2016

(87) PCT Pub. No.: WO2016/001187
PCT Pub. Date: Jan. 7, 2016

(65) Prior Publication Data

US 2017/0138356 A1 May 18, 2017

(30) Foreign Application Priority Data

Jun. 30, 2014 (FR) ..... 14 56210

(51) Int. Cl.
*F04B 7/00* (2006.01)
*F04B 19/04* (2006.01)
(Continued)

(52) U.S. Cl.
CPC ..... *F04B 7/0003* (2013.01); *F04B 7/0007* (2013.01); *F04B 13/00* (2013.01);
(Continued)

(58) Field of Classification Search
CPC .... F04B 7/0007; F04B 7/0011; F04B 7/0015; F04B 13/00; F04B 15/02; F04B 19/04;
(Continued)

(56) References Cited

U.S. PATENT DOCUMENTS 937,790 A * 10/1909 Green ..... F04B 39/08 417/515
3,694,112 A * 9/1972 Freedman ..... F04B 39/08 417/515
(Continued)

FOREIGN PATENT DOCUMENTS

DE 102012102274 A1 9/2013
EP 0604888 A1 7/1994
(Continued)

OTHER PUBLICATIONS

International Search Report dated Oct. 15, 2015.

*Primary Examiner* — Kenneth J Hansen
*Assistant Examiner* — Chirag Jariwala
(74) *Attorney, Agent, or Firm* — Dickinson Wright PLLC

(57) ABSTRACT

A volumetric pump comprising a product metering piston 28 mounted inside a metering chamber 22 so as to slide, a sleeve 14 at least partially delimiting an intake chamber 16 and an exhaust chamber 18 for the product, and a product dispensing means 24 is provided. The dispensing means comprises an intake member 34 comprising product passage means 44*d* that are able to at least partially face an inlet orifice 48 of the metering chamber, and an exhaust member 36 comprising product passage means 50*d* that are able to at least partially face an outlet orifice 54 of said chamber. The
(Continued)

intake and exhaust members are situated axially on either side of an internal partition 42 of the sleeve and are each mounted so as to bear axially against said partition.

11 Claims, 2 Drawing Sheets

(51) Int. Cl.

| | |
|---|---|
| ***F04B 53/10*** | (2006.01) |
| ***F04B 17/00*** | (2006.01) |
| ***F04B 13/00*** | (2006.01) |
| ***F04B 15/02*** | (2006.01) |
| ***F04B 19/22*** | (2006.01) |

(52) U.S. Cl.
CPC ..... *F04B 15/02* (2013.01); *F04B 17/00* (2013.01); *F04B 19/04* (2013.01); *F04B 19/22* (2013.01); *F04B 53/109* (2013.01)

(58) Field of Classification Search
CPC ..... F04B 19/22; F04B 53/109; F04B 53/14; F04B 53/16; F04B 7/0003; F04B 7/0042–0053; F04B 17/00; F04B 17/03
USPC ..... 417/519; 137/625.2, 625.21, 876
See application file for complete search history.

(56) References Cited

U.S. PATENT DOCUMENTS

| | | | | |
|---|---|---|---|---|
| 4,989,576 | A * | 2/1991 | Coates | F01L 7/10 123/190.14 |
| 5,466,132 | A * | 11/1995 | Deal | F04B 7/0007 137/876 |
| 6,641,766 | B1 * | 11/2003 | Ishiwatari | F04B 1/1072 264/211.23 |
| 8,353,688 | B2 | 1/2013 | Navarro | |
| 2009/0196775 | A1 | 8/2009 | Navarro | |
| 2014/0196600 | A1 * | 7/2014 | Huang | F04B 7/0007 417/360 |
| 2015/0064036 | A1 | 3/2015 | Eberhard | |

FOREIGN PATENT DOCUMENTS

| | | | | |
|---|---|---|---|---|
| FR | 2911374 | A1 * | 7/2008 | F04B 7/0007 |
| WO | 2007141681 | A2 | 12/2007 | |

* cited by examiner

POSITIVE-DISPLACEMENT PISTON PUMP AND ROTARY DISTRIBUTION MEANS

This application is a 371 national phase entry of PCT/EP2015/064777, filed 30 Jun. 2015, which claims benefit of French Patent Application No. 1456210, filed 30 Jun. 2014, the entire contents of which are incorporated herein by reference for all purposes.

BACKGROUND

1. Technical Field

The present invention relates to the field of positive-displacement piston pumps.

An advantageous application of such a pump relates to the supply of rubber to an extruder intended to form a profiled element for manufacturing a vehicle tire. Such a pump can, of course, be used for all kinds of viscous and liquid products.

2. Related Art

Conventionally, a positive-displacement or volumetric pump comprises a product metering piston mounted in a cylinder of the pump body forming a metering chamber so as to slide, and means for actuating the piston, for example a cam in contact with one end of the latter.

One type of volumetric pump also comprises a dispensing plug mounted so as to rotate inside a sleeve of the pump body in order to place the metering chamber alternately into communication with an intake chamber and an exhaust chamber of the sleeve, by way of an orifice provided in the thickness of said sleeve.

To this end, first and second groups of grooves are formed on the outer surface of the plug and are arranged so as to pass in front of the orifice in the sleeve during the rotation of the plug so as to place the metering chamber successively into communication with the intake chamber and then with the exhaust chamber.

Thus, the pumped product flows from the intake chamber to the metering chamber, and then from this metering chamber to the exhaust chamber, passing through the same orifice. For more details relating to a pump of this type, reference may be made for example to the patent application EP-A1-0 604 888.

With such a pump, it is necessary to provide a radial functional clearance between the outer surface of the rotary plug and the bore of the sleeve of the pump body holding the plug. Moreover, this clearance tends to enlarge with the radial friction and wear that exist between the plug and the sleeve. As a result, leaks of the product present inside the intake chamber directly towards the exhaust chamber can occur, notably when the pumped product is rubber or some other viscous product that has low viscosity.

Furthermore, such leaks can also exist along the outer surface of the plug, circumferentially between the intake grooves and the exhaust grooves in the event of this outer surface being worn, for example by scratches, abrasion, etc., which can be caused by contaminating particles contained in the product to be pumped.

With such uncontrolled flows of product between the intake and exhaust grooves of the plug and/or between the plug and the sleeve of the pump body, the flow rate of the pump can be irregular.

SUMMARY

The present invention aims to overcome the above-mentioned drawback.

More particularly, the present invention aims to provide a volumetric pump exhibiting a regular flow rate and a simple design.

In one embodiment, the volumetric pump comprises a product metering chamber, a metering piston mounted inside said chamber so as to slide, a sleeve at least partially delimiting an intake chamber and an exhaust chamber for the product, and a product dispensing means that is mounted so as to be able to rotate inside the sleeve about an axis and is able to place the metering chamber alternately into communication with the intake chamber and the exhaust chamber.

The dispensing means comprises an intake member comprising product passage means that are able to at least partially face an inlet orifice of the metering chamber in order to place said chamber in communication with the intake chamber, and an exhaust member comprising product passage means that are able to at least partially face an outlet orifice of the metering chamber in order to place said chamber in communication with the exhaust chamber. The intake and exhaust members are situated axially on either side of an internal partition of the sleeve and are each mounted so as to bear axially against said partition.

The dispensing means also comprises holding means for keeping the intake and exhaust members bearing against the internal partition of the sleeve.

The dispensing means is designed to separate the intake and exhaust functions for the product, which are each carried out by a specific member. The product passage means of each member ensure a single intake or exhaust function. The mounting of each intake or exhaust member in axial abutment against the partition of the pump body and also the maintaining of this axial contact make it possible to avoid leaks of product between the intake chamber and the exhaust chamber.

Moreover, with the use of two different members that are axially separated by the partition of the pump body, the passage means for intake are spaced apart axially from those provided for exhaust, thereby preventing a circumferential flow of product between these means. A pump having improved internal sealing that promotes a regular flow rate is thus provided. The flow rate is no longer linked to the wear to the dispensing means. Moreover, two orifices that are each specific to the intake of product or to the exhaust thereof are also provided.

Preferably, each of the intake and exhaust members comprises a flat front face mounted so as to bear axially against the internal partition of the sleeve. Planar contact between each intake or exhaust member and the partition promotes good sealing between the intake and exhaust chambers.

In one embodiment, each of the intake and exhaust members comprises a body provided with product passage means, and a friction ring that rotates as one with said body and is mounted so as to bear axially against the internal partition of the sleeve. This disposition makes it possible to reduce the frictional forces between the intake and exhaust members and the sleeve.

In one embodiment, the holding means comprise at least one elastic preloading means that is able to exert an axial preloading force on one of the intake and exhaust members.

Thus, it is possible to ensure that the axial contact between the partition of the sleeve and the intake and exhaust members is maintained before the pump is used for the first time, i.e. when the product to be metered does not fill the intake and exhaust chambers. This axial preloading force furthermore allows an axial clearance compensation between the intake and exhaust members and the partition in the event of wear by friction.

The dispensing means can also comprise a common support shaft on which the intake and exhaust members are mounted. Preferably, the holding means are also mounted on said shaft.

Advantageously, the intake and exhaust members and the internal partition of the sleeve are annular.

The internal partition may be situated axially between the inlet and outlet orifices of the metering chamber. In one embodiment, the inlet and outlet orifices are formed in the thickness of the sleeve.

The passage means may comprise grooves formed on the outer surfaces of the intake and exhaust members.

BRIEF DESCRIPTION OF THE DRAWINGS

The present invention will be understood better from reading the detailed description of an embodiment considered by way of entirely non-limiting example and illustrated by the appended figures, in which.

DETAILED DESCRIPTION OF EXAMPLE EMBODIMENTS

Figure 1:
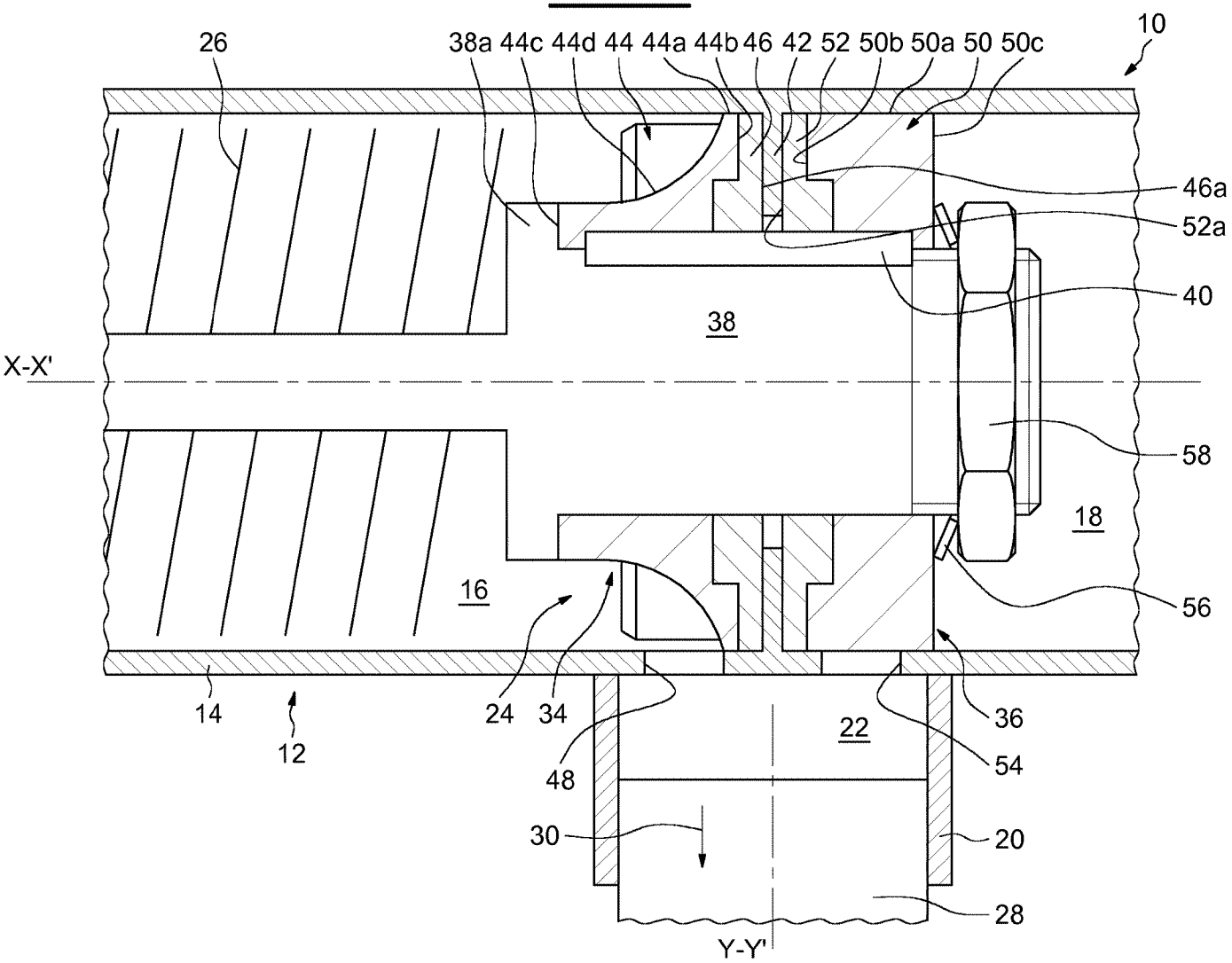
FIG. 1 is a partial schematic view in cross section of a volumetric pump according to one exemplary embodiment of the invention in an intake position for the product.
Figure 2:
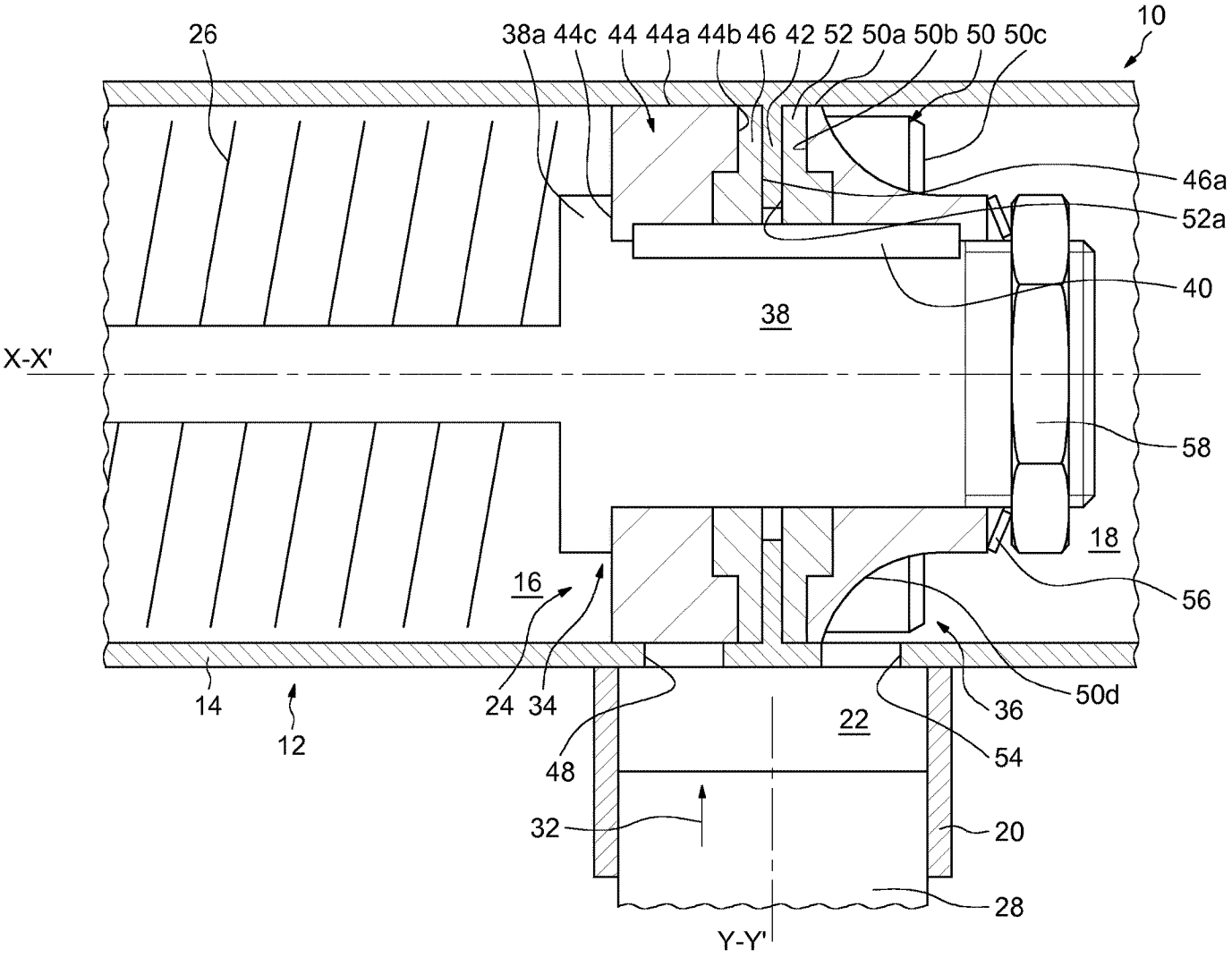
FIG. 2 is a partial schematic view in cross section of the pump from FIG. 1 in an exhaust position for said product.

FIGS. 1 and 2 show an exemplary embodiment of a volumetric pump, bearing the overall reference 10, provided for dispensing a viscous product, such as an elastomer that can be made of non-vulcanized rubber.

The pump 10 comprises a pump body 12 provided with a sleeve 14 delimiting an intake chamber 16 and a delivery or exhaust chamber 18, and with a cylinder 20 delimiting a metering chamber 22. The sleeve 14 has an axis X-X' of elongation and the cylinder 20 has an axis Y-Y' of elongation orthogonal to the axis X-X'. The cylinder 20 is fixed to the sleeve 14. In the exemplary embodiment illustrated, the metering chamber 22 is offset radially outwards with respect to the intake chamber 16 and exhaust chamber 18. Throughout the description, the terms "axial, radial and circumferential" are defined with respect to the axis X-X'.

The pump 10 also comprises a product dispensing means 24 which is mounted inside the sleeve 14 so as to be able to rotate about the axis X-X'. As will be described in more detail below, the dispensing means 24 is designed to place the metering chamber 22 alternately into communication with the intake chamber 16 and the exhaust chamber 18 by way of two different members, and also to avoid leaks of product between these chambers. The intake chamber 16 and exhaust chamber 18 are separated from one another by the dispensing means 24.

In the exemplary embodiment illustrated, the pump 10 also comprises a feed screw 26 of the endless type that is disposed in the intake chamber 16 and makes it possible to ensure that the product is moved from an introduction orifice (not shown) of the chamber in the direction of the dispensing means 24 and to pressurize the pumped product. The dispensing means 24 is secured to the screw 26 and the axis X-X' of said means is coincident with that of the screw. Alternatively, it is possible to provide some other feed means for obtaining the forced mechanical transfer of the product towards the dispensing means 24 against which said product is pressed under pressure. In another variant, it is possible for the pump not to have a feed means, depending on the product to be metered.

The pump 10 also comprises a product metering piston 28 which is mounted inside the metering chamber 22 so as to slide along the axis Y-Y'. The sliding movement of the metering piston 28 is perpendicular to the rotation axis X-X' of the dispensing means 24. The piston 28 is mounted so as to slide between positions of maximum and minimum volume of the metering chamber 22 which correspond respectively to bottom dead centre and top dead centre of said piston.

During a product intake phase which is illustrated in FIG. 1, under the effect of the pressure of the product which is dispensed by the dispensing means 24 from the intake chamber 16 to the metering chamber 22, the piston 28 moves from top dead centre to bottom dead centre. This movement toward bottom dead centre is illustrated schematically by the arrow bearing the reference 30. During an exhaust phase illustrated in FIG. 2, the piston 28 moves from bottom dead centre to top dead centre under the effect of actuating means (not shown) of said pump. This movement toward top dead centre is represented by the arrow bearing the reference 32. The actuating means can for example comprise a cam mounted in contact with the lower end of the metering piston 28. The movement of the dispensing means 24 in rotation and the movement of the piston 28 in translation are synchronized.

The dispensing means 24 comprises an intake member 34 for the product, an exhaust member 36 for said product that is spaced apart axially from said intake member, and a common support shaft 38 of axis X-X' on which said members are mounted. The annular intake and exhaust members 34, 36 rotate as one with said shaft 38 by way of a key 40. The intake and exhaust members 34, 36 can slide axially on the shaft 38 along the key 40. The shaft 38 is secured to the feed screw 26.

The intake and exhaust members 34, 36 are disposed axially on either side of an internal partition 42 of the sleeve and bear axially against said partition. The partition 42, of annular shape, axially separates the intake chamber 16 from the exhaust chamber 18. The partition 42 extends inwards from the bore of the sleeve. The partition 42 extends radially into the vicinity of the support shaft 38, remaining at a radial distance therefrom. The partition 42 has two opposite flat front faces against each of which one of the intake and exhaust members 34, 36 bears axially.

The intake member 34 is disposed in the intake chamber 16. The intake member 34 comprises a body 44 and a friction ring 46 mounted so as to bear axially against said body. The body 44 and the friction ring 46 rotate as one with the shaft 38 by way of the key 40. The body 44 is mounted so as to bear axially against a shoulder 38*a* of the shaft and the friction ring 46 bears axially against the partition 42 of the sleeve. The shoulder 38*a* of the shaft is situated in this case at one axial end of said shaft and extends radially outwards. The shoulder 38*a* forms a holding means for maintaining the axial position of the intake member 34 bearing against the partition 42 of the sleeve. The holding means is mounted so as to bear axially against the intake member 34. Alternatively, it may be possible to replace the shoulder 38*a* with some other axial stopping element, for example of the circlip type.

The body 44 comprises a cylindrical axial outer surface 44*a* that is centred in the bore of the sleeve 14 and two opposite radial front faces 44*b*, 44*c* that axially delimit said outer surface. The front face 44*b* is oriented axially towards the internal partition 42 of the sleeve and forms a bearing face for the friction ring 46. The front face 44*c* is oriented axially towards the product introduction orifice in the intake chamber 16. The front face 44*c* is mounted so as to bear axially against the shoulder 38*a* of the shaft.

The body 44 of the intake member further comprises a plurality of recesses or grooves 44*d* that are formed on the outer surface 44*a* and lead onto the front face 44*c*. The grooves 44*d* are spaced apart from one another in the circumferential direction, preferably in a regular manner.

During the rotation of the intake member 34, and more generally of the dispensing means 24, the grooves 44*d* pass in front of an inlet orifice 48 of the metering chamber 22. The grooves 44*d* place the metering chamber 22 into fluidic communication with the intake chamber 16.

The exhaust member 36 has a similar design to that of the intake member 34. The exhaust member 36 is disposed in the exhaust chamber 18. The exhaust member 36 comprises a body 50 and a friction ring 52 mounted so as to bear axially against said body 50. The body 50 and the friction ring 52 rotate as one with the shaft 38 by way of the key 40. The friction ring 52 is mounted so as to bear axially against the partition 42 of the sleeve on the side axially away from the intake member 34.

The body 50 comprises a cylindrical axial outer surface 50*a* that is centred in the bore of the sleeve 14 and two opposite radial front faces 50*b*, 50*c* that axially delimit said outer surface. The front face 50*b* is oriented axially towards the internal partition 42 of the sleeve and forms a bearing face for the friction ring 52. The front face 50*c* is oriented axially towards a product evacuation orifice (not shown) in the exhaust chamber 18.

The body 50 of the exhaust member 36 also comprises a plurality of recesses or grooves 50*d* that are formed on the outer surface 50*a*, lead onto the front face 50*c* and are spaced apart from one another in the circumferential direction. During the rotation of the dispensing means 24, the grooves 50*d* pass in front of an outlet orifice 54 of the metering chamber 22. The grooves 50*d* place the metering chamber 22 into fluidic communication with the exhaust chamber 18.

The grooves 50*d* in the exhaust member are disposed relative to the grooves 44*d* in the intake member such that when one of the grooves 44*d* faces the inlet orifice 48 of the metering chamber 22, none of the grooves 50*a* of the exhaust member are positioned facing the outlet orifice 54. In this intake position for the intake of product into the metering chamber 22, the outlet orifice 54 is closed off by the outer surface 50*a* of the exhaust member, as illustrated in FIG. 1.

Conversely, in the exhaust position for the exhaust of product from the metering chamber 22, one of the grooves 50*d* faces the outlet orifice 54 and the outer surface 44*a* of the intake member closes off the inlet orifice 48. Thus, the dispensing means 24 makes it possible to place the metering chamber 22 alternately into communication with the intake chamber 16 and the exhaust chamber 18.

In the exemplary embodiment illustrated, the inlet orifice 48 and the outlet orifice 54 are formed in the thickness of the sleeve 14 of the pump body and lead into the metering chamber 22. The orifices 48, 54 in this case extend radially through the thickness of the sleeve 14. The orifices 48, 54 are situated radially facing the metering piston 26 and are disposed radially above top dead centre of said piston. The orifices 48, 54 are situated axially on either side of the partition 42, on the intake chamber 16 side and the exhaust chamber 18 side, respectively.

The rotary friction rings 46, 52, having an annular overall shape, are mounted so as to bear axially against the fixed partition 42 of the pump body. The partition 42 is in axial contact with the friction ring 46 of the intake member on one side and is in axial contact with the friction ring 52 of the exhaust member on the other side. Each friction ring 46, 52 comprises a flat, in this case radial, front face 46*a*, 52*a* that is mounted in axial contact with the internal partition 42 of the sleeve. Advantageously, each friction ring 42, 52 is made of a material that has a low coefficient of friction and can have self-lubricating properties and good resistance to wear, for example bronze, graphite, etc.

The dispensing means 24 also comprises an annular washer 46 that is mounted on the shaft 38 and bears axially against the exhaust member 36, and a nut 58 that is screwed onto a threaded part of said shaft (not referenced) and axially blocks the washer 56. The washer 56 is mounted so as to bear axially against the front face 50*c* of the exhaust member 36. The washer 56 can be for example of the Belleville type. The washer 56 is able to exert an axial force on the exhaust member 36 so as to apply an axial preload that tends to keep said member pressed against the partition 42 of the sleeve. Alternatively, it is possible to use any other elastic preloading means having axial elasticity that is able to exert an axial preloading force on the exhaust member 36. It may also be conceivable to attach several preloading means stacked axially between the nut 58 and the exhaust member 36.

The washer 56 and the nut 58 form holding means for maintaining the axial position of the exhaust member 36 bearing against the partition 42 of the sleeve.

These holding means are mounted so as to bear axially against the exhaust member 36. Alternatively, it may be possible not to provide an elastic washer 56 and to mount the nut 58 directly against the exhaust member 36. In another variant, it may also be possible to replace the nut with some other axial stopping element, for example of the circlip type.

By virtue of embodiments of the invention, a pump is provided that comprises a dispensing means designed to separate the intake and exhaust functions for the product, which are each carried out by a specific element. In order to ensure this separation, the passage means of each member ensure a single intake or exhaust function. The axial contact between each intake or exhaust member and the partition of the pump body makes it possible to avoid leaks of product between the intake chamber and the exhaust chamber in an effective and economical manner, even with the presence of a radial functional clearance between the dispensing means and the bore of the sleeve of the pump body. A regular flow rate is promoted.

In operation, the product pressure applied axially to the intake member and/or the product pressure applied axially to the exhaust member promote axial pressing of said members against the partition of the sleeve. In the event of wear by friction, the product pressure on the intake side and/or the product pressure on the exhaust side make it possible to maintain this pressing. The axial preloading force exerted by the washer also promotes the maintaining of the axial contact between the partition of the sleeve and the intake and exhaust members in the event of wear.

Furthermore, given the disposition of the intake and exhaust members axially on either side of the partition of the sleeve, the passage means for the intake of product are offset axially with respect to the passage means for the exhaust. Thus, a flow of product between the means provided for intake and those for exhaust is avoided in the event of wear to the outer surface of the dispensing means.

In the exemplary embodiment illustrated, each intake or exhaust member comprises a body and a separate friction ring for limiting the friction with the partition of the pump body. Alternatively, each member may be formed only by the body and may preferably comprise an anti-friction and anti-wear coating. In another variant, a friction ring or a coating may be provided on each lateral face of the fixed internal partition of the pump body.

In another variant, each of the intake and exhaust members may comprise, instead of the friction ring, a seal, for example an O-ring seal or a lip seal, that rubs against the partition of the sleeve. Alternatively, it may also be possible to provide a partition that comprises, on each of its front faces, a seal that rubs against the associated intake or exhaust member.

The invention claimed is:

1. A volumetric pump for dispensing a product comprising:

a product metering chamber, a metering piston mounted inside said product metering chamber so as to slide, a sleeve at least partially delimiting an intake chamber and an exhaust chamber for said product, a product dispenser that is mounted so as to be able to rotate inside the sleeve and is able to place the product metering chamber alternately into communication with the intake chamber and the exhaust chamber, and a feed member that ensures forced mechanical transfer of the product towards the product dispenser, wherein the product dispenser comprises:

an intake member comprising first product passages that at least partially face an inlet orifice of the product metering chamber in order to place said product metering chamber in communication with the intake chamber, and an exhaust member comprising second product passages that at least partially face an outlet orifice of the product metering chamber in order to place said product metering chamber in communication with the exhaust chamber, said intake and exhaust members being situated axially on either side of an internal partition of the sleeve and each being mounted so as to bear axially against said internal partition of the sleeve, and a holder keeping the intake and exhaust members bearing against the internal partition of the sleeve.

2. The pump according to claim 1, wherein each of the intake and exhaust members comprises a flat front face mounted so as to bear axially against the internal partition of the sleeve.

3. The pump according to claim 1, wherein the intake member comprises a first body provided with the first product passages and the exhaust member comprises a second body provided with the second product passages, and each of the first and second bodies comprises a friction ring that rotates as one with said body and is mounted so as to bear axially against the internal partition of the sleeve.

4. The pump according to claim 1, wherein the holder comprises at least one elastic preloader that is able to exert an axial preloading force on one of the intake and exhaust members.

5. The pump according to claim 1, wherein the first and second product passages comprise grooves formed on outer surfaces of the intake and exhaust members.

6. The pump according to claim 1, wherein the feed member is disposed in the intake chamber.

7. The pump according to claim 1, wherein the intake and exhaust members and the internal partition of the sleeve are annular.

8. The pump according to claim 1, wherein the internal partition of the sleeve is situated axially between the inlet and outlet orifices of the product metering chamber.

9. The pump according to claim 1, wherein the inlet and outlet orifices of the product metering chamber are formed in a thickness of the sleeve.

10. The pump according to claim 1, wherein the product dispenser further comprises a common support shaft on which the intake and exhaust members are mounted.

11. The pump according to claim 10, wherein the holder is mounted on said shaft.

* * * * *